US007066235B2

(12) United States Patent
Huang

(10) Patent No.: US 7,066,235 B2
(45) Date of Patent: Jun. 27, 2006

(54) METHOD FOR MANUFACTURING CLAD COMPONENTS

(75) Inventor: Xiaodi Huang, Houghton, MI (US)

(73) Assignee: Nanometal, LLC, Reed City, MI (US)

( * ) Notice: Subject to any disclaimer, the term of this patent is extended or adjusted under 35 U.S.C. 154(b) by 621 days.

(21) Appl. No.: 10/140,239

(22) Filed: May 7, 2002

(65) Prior Publication Data

US 2003/0209288 A1 Nov. 13, 2003

(51) Int. Cl.
*B22D 19/00* (2006.01)
*B22D 19/16* (2006.01)

(52) U.S. Cl. ..... 164/98; 164/111; 164/112

(58) Field of Classification Search ..... 164/91, 164/94, 95, 98, 100, 111, 112
See application file for complete search history.

(56) References Cited

U.S. PATENT DOCUMENTS

| | | | | |
|---|---|---|---|---|
| 4,023,613 | A * | 5/1977 | Uebayasi et al. | 164/100 |
| 4,154,900 | A * | 5/1979 | Kaku et al. | 428/554 |
| 4,576,875 | A * | 3/1986 | Olsson et al. | 428/627 |
| 4,807,728 | A | 2/1989 | Suenaga et al. | 188/260 |
| 5,183,632 | A | 2/1993 | Kiuchi et al. | 419/48 |
| 5,190,091 | A * | 3/1993 | Revankar | 164/97 |
| 5,207,776 | A | 5/1993 | Pearce | |
| 5,224,572 | A | 7/1993 | Smolen, Jr. et al. | 188/218 |
| 5,226,469 | A * | 7/1993 | Matsumura et al. | 164/111 |
| 5,620,042 | A * | 4/1997 | Ihm | 164/95 |
| 5,862,892 | A * | 1/1999 | Conley | 188/218 XL |
| 5,884,388 | A | 3/1999 | Patrick et al. | 29/527.2 |
| 6,136,374 | A | 10/2000 | Reuscher | 427/233 |
| 6,216,826 | B1 | 4/2001 | Botzet | 188/181 R |
| 6,321,885 | B1 | 11/2001 | Wendt | 188/218 X |
| 6,357,557 | B1 | 3/2002 | Di Ponio | 188/18 A |
| 6,427,754 | B1 * | 8/2002 | Ozcan | 164/95 |
| 2001/0045332 | A1 | 11/2001 | Takabashi et al. | 188/218 |
| 2004/0178029 | A1 | 9/2004 | Hoyte et al. | 188/218 XL |

FOREIGN PATENT DOCUMENTS

JP H09-042339 A 2/1997

* cited by examiner

*Primary Examiner*—Kevin P. Kerns
(74) *Attorney, Agent, or Firm*—Brooks Kushman P.C.

(57) ABSTRACT

A method for manufacturing a clad component in which a cladding workpiece having a section comprising a first metal onto which a number of metal beads are rigidly bonded is inserted into a mold. A molten second metal is poured into the mold, where it flows about and covers the beads and is then permitted to cool. This process forms an article made of the second metal, which is mechanically interlocked to the beads, clad by the first metal. Typically the first metal is a high-melting point strong metal, such as steel, and the second metal is a lower-melting point, weaker, but lighter metal, such as aluminum.

26 Claims, 1 Drawing Sheet

METHOD FOR MANUFACTURING CLAD COMPONENTS

BACKGROUND OF THE INVENTION

Driven by the desire to reduce automobile weight and improve fuel efficiency, the auto industry has dramatically increased aluminum use in automobiles in recent years. To further reduce weight, more iron and steel components need to be replaced with aluminum. Aluminum and its alloys have many attractive properties. Poor wear resistance, however, and low working temperature limit its potential wider uses. To solve the above noted problems, various methods of manufacturing lightweight components made of ceramic-reinforced aluminum metal matrix composites (MMC) or so-called ceramic metal composites (CMC) have been disclosed. In these methods, molten aluminum mixed with ceramic particles is poured into a mold to produce a component, or molten aluminum infiltrates a porous ceramic preform to produce a component. The aluminum MMC does improve wear resistance, but creates other problems. The aluminum MMC is very brittle, with about a 90% reduction in ductility with 10–15 vol. % ceramic particles in an aluminum matrix. As a result, monolithic aluminum MMC components are more prone to sudden catastrophic failure. This would likely cause serious liability problems if MMC was used for safety-sensitive parts such as a brake rotor and drum. In addition, it is difficult to machine aluminum MMC to final specifications. The SiC or alumina in the aluminum MMC wears cutting tools very fast. Also, aluminum MMC brake rotors do not stand the friction heat well, causing adhesive wear and galling on the rotor rubbing surfaces. Finally, aluminum MMC material is also expensive.

U.S. Pat. No. 5,183,632 discloses a method of manufacturing an aluminum disc rotor with aluminum composite rubbing surfaces which consists of aluminum and ceramic powders and are bonded to the aluminum rotor body by heating and pressing.

U.S. Pat. No. 5,224,572 discloses a lightweight brake rotor with a thin ceramic coating on rubbing surfaces.

U.S. Pat. No. 5,884,388 discloses a method of manufacturing a friction-wear aluminum part by thermally arc-spraying a mixture of aluminum and stainless steel onto the wear surface.

U.S. Patent Application Pub. No. 2001/0045332 A1 discloses a titanium or aluminum brake disc bonded with stainless steel on the rubbing surfaces by brazing.

Japanese Patent Application No. JP-A No. H9-42339 discloses an aluminum brake disc bonded with an alloy steel on the rubbing surfaces by explosive cladding.

SUMMARY OF THE INVENTION

The present invention is a method for manufacturing a clad component in which a cladding workpiece having a section comprising a first metal onto which a number of metal beads are rigidly bonded is inserted into a mold. A molten second metal is poured into the mold, where it flows about and covers the beads and is then permitted to cool. This process forms an article made of the second metal, which is mechanically interlocked to the beads, clad by the first metal. Typically the first metal is a high-melting point strong metal, such as steel, and the second metal is a lower-melting point, weaker, but lighter metal, such as aluminum.

The foregoing and other objectives, features and advantages of the invention will be more readily understood upon consideration of the following detailed description of the preferred embodiment(s), taken in conjunction with the accompanying drawings.

DETAILED DESCRIPTION

A preliminary cladding workpiece 1 that is 0.5–20 mm thick, preferably 1–5 mm thick, and made of a strong, high-melting point metal, such as steel, is manufactured by blanking, cutting, bending and/or drawing from a metal sheet. Alternatively, preliminary workpiece 1 may be manufactured by metal casting, powder metallurgy, extrusion, forging, welding, machining, or other means. In another alternative embodiment, workpiece 1 is manufactured from a laminated metal sheet. The laminated metal sheet consists of metal bonded to a "surface material," such as a different metal or a composite consisting of a metal matrix and particles of ceramic or graphite or both, or whisker or fiber reinforcement.

Figure 1:
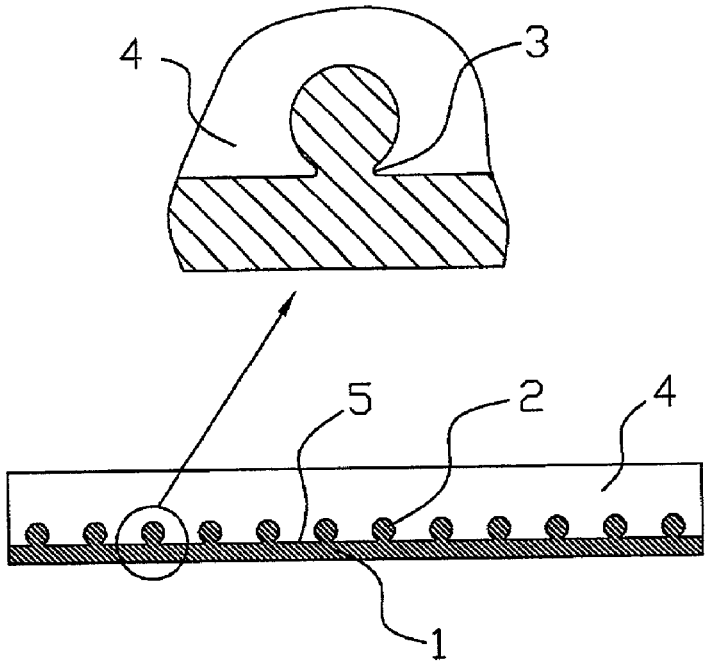
FIG. 1 shows the mechanical interlocking mechanism disclosed by this invention.

A binder, preferably organic, such as rosin, gum, glue, dextrin, acrylic, cellulose, phenolic or polyurethane, is applied to a portion of the preliminary cladding workpiece 1 (FIG. 1) evenly or in a certain pattern. As an alternative embodiment, the binder is blended with additives. These additives may consist of metal and/or carbon particles in the size range from 0.1–500 μm (micrometers), preferably 25–147 μm (micrometers), in the binder and additive ratio up to 1:10, preferably either 50:1 to 10:1 or 1:1 to 1:6.

Metal beads 2 (FIG. 1), which may be of either regular or irregular shapes, adhere on the binder-applied surface 5 of the cladding work piece 1. The regular or irregular shapes may include spherical, cylindrical, polyhedral, ellipsoidal, T-shape, I-shape, L-shape, V-shape, screw, cone, staple, and other shapes which can generate mechanical interlocking. Equal-size metal spheres of 0.5–20 mm in diameter have been found to yield good results. These metal beads 2 adhere on the binder-bearing surface 5 by a random distribution or in a certain distribution pattern. Alternatively, binder may be applied to the beads 2, rather than, or in addition to, the surfaces 5 of the cladding workpiece 1. The distance between beads is preferably 1.5–10 times of the bead's diameter. As an alternative embodiment, the metal beads 2 adhere on the entire binder-bearing surface 5 in one layer. As another alternative embodiment, the metal beads 2 adhere on the binder-applied surface 5 in more than one layer, with binder applied between the layers to bind the layers of beads together.

The workpiece 1, now including the binder and the beads 2, is loaded into a furnace. At an elevated temperature, the binder and possibly a portion of the beads 2 and the cladding workpiece surface material 5, form a transient metal liquid. The transient metal liquid forms necks 3 (FIG. 1) on the beads 2. Due to atomic diffusion of elements in the metal necks to adjacent regions, the metal necks become solid at the elevated temperature. The cross-sectional diameter of a metal neck 3 is smaller than the bead's diameter, preferably ⅓–⅔ of the bead's diameter. After cooling, the beads 2 are welded onto the preliminary cladding workpiece 1 through the metal necks 3. As an alternative embodiment, the binder itself forms metal liquid and builds metal necks at an elevated temperature. The metal necks become solid after cooling. As an alternative embodiment, metal beads 2 bonded on the binder-bearing surface 5 in more than one layer form a porous metal layer on the preliminary cladding workpiece 1. The beads are held together by the transient metal liquid during heating in a furnace. After cooling, this porous metal layer is firmly bonded on the thin article 1 by way of the solidified transient metal liquid. The pores in the porous metal layer are interconnected.

As an alternative, several workpieces are prepared simultaneously by following the above method using a larger original preliminary cladding workpiece, which is then cut into pieces after the beads are firmly adhered to it. At least some of the pieces are then used as cladding workpieces in the final steps of the process.

Carburizing and nitriding may be conducted on the cladding work piece 1 during heating by controlling the atmosphere of the furnace during the heating procedure. Other heat treatments such as annealing, normalizing, quenching and tempering also can be performed during heating in the furnace.

The cladding workpiece can be further shaped by bending, punching, drawing or welding. The metal beads 2 can be deformed by pressing to form them into shapes better adapted for mechanical interlocking. The cladding workpiece can be coated or plated with a material partially or entirely by chemical vapor deposition, physical vapor deposition, thermal spray coating, plating, spraying, brushing, or dipping. In addition, the cladding workpiece can be treated by flame hardening, laser surface hardening, or electron beam surface hardening.

The cladding workpiece is then inserted into a sand or metal mold. Second metal 4 (FIG. 1) is melted and cast into this mold to form a component with the cladding workpiece 1. Any metal casting methods commonly used by the metal casting industry, such as green sand casting, die casting, squeeze casting, coremaking and inserting, investment casting, lost foam casting, and others, can be used in this invention. Although metallurgical bonding may exist, the first metal surface, including the surface of the beads 2 and the necks 3 and the cladding workpiece surface 5 bonds with the second metal body 4 primarily by mechanical interlocking, such as the second metal catches the necks of beads 3 or penetrates into the pores of the porous layer. The resulting component is machined, if necessary, to produce the final product with the required dimension accuracy and enhanced properties on the working surface/surfaces.

To enhance performance, the critical surface/surfaces can be roughened by sand blasting, drilled, slotted, or machined by other means. To further enhance the surface properties, the critical surface/surfaces can be hardened by chemical vapor deposition, physical vapor deposition, laser surface hardening, or electron beam surface hardening.

Figure 2:
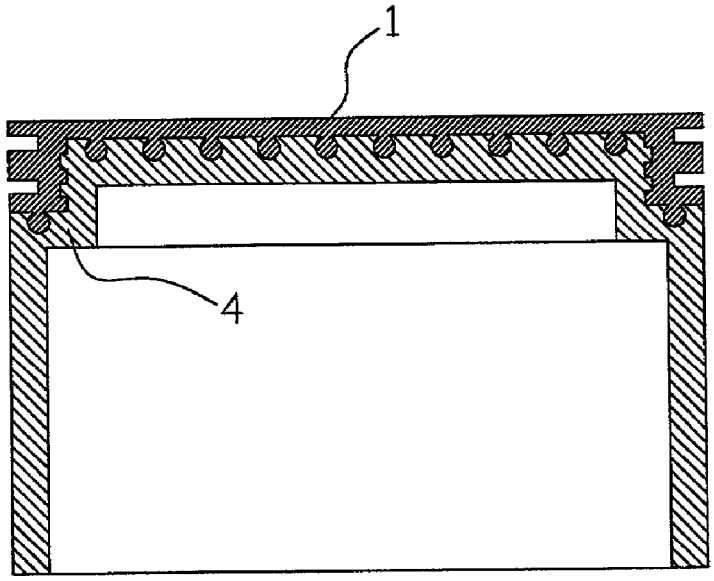
FIG. 2 shows the bonding structure of a steel-capped aluminum piston.

FIG. 2 illustrates the structure of a steel-capped aluminum piston.

Dynamometer test results demonstrate that a steel-surfaced aluminum brake rotor produced by the methods described above presents equivalent braking performance in comparison with a cast iron rotor that weighs about twice as much. The steel-surfaced aluminum brake rotor has the same dimensions and was tested under the identical conditions as the cast iron rotor. During a destruction fade test, the steel-surfaced aluminum brake rotor worked until the rotor surface temperature was over 1400 degrees F.

Parts made according to this method are projected for use in various applications for which light weight is desirable, but which also require enhanced surface properties such as wear resistance, thermal barrier, higher operation temperatures, and a desirable coefficient of friction. These applications include steel surfaced aluminum brake rotors, drums, pistons, gears, army tank tracks and clutch components. Projected applications also include steel surfaced magnesium components, steel surfaced titanium components, and other multiple material systems.

The terms and expressions that have been employed in the foregoing specification are used as terms of description and not of limitation. There is no intention, in the use of such terms and expressions, of excluding equivalents of the features shown and described or portions thereof, it being recognized that the scope of the invention is defined and limited only by the claims which follow.

What is claimed is:

1. A method for manufacturing a clad component comprising:

(a) providing a cladding workpiece having a section comprising a first metal, said section having an external surface area;

(b) providing a multiplicity of metal beads separate from the cladding workpiece, each metal bead having a cross-section of at least 0.5 mm;

(c) bonding the multiplicity of metal beads rigidly to at least a portion of said external surface area:

(d) inserting said workpiece into a mold;

(e) providing a molten second metal; and (f) pouring said molten second metal into said mold so that it flows about and covers said beads and permitting said molten second metal to cool, thereby forming an article made of said second metal, which is mechanically interlocked to said beads, clad by said first metal.

2. The method of claim 1, wherein said mold is a sand mold.

3. The method of claim 1, wherein said mold is a metal mold.

4. The method of claim 1, further comprising machining said clad component to a specified shape having specified surface characteristics.

5. The method of claim 1, wherein said metal beads each have a first end rigidly bonded to the cladding workpiece and a second free end that is covered by and interlocked within said second metal.

6. The method of claim 1, wherein said metal beads are each generally spherical.

7. The method of claim 6, wherein said metal beads have a diameter of 0.5–20 millimeters.

8. A method for manufacturing a clad component comprising:

(a) forming a cladding workpiece by:

(i) providing a preliminary workpiece made of a first metal and having a preliminary workpiece external surface area, (ii) providing a binder, (iii) providing a set of metal beads, (iv) using said binder to adhere said set of metal beads over at least a portion of said preliminary workpiece external surface area, and (v) heating said preliminary workpiece and permitting said preliminary workpiece to cool, wherein said heating and cooling is sufficient to form a rigid bond between said metal beads and said portion of said preliminary workpiece external surface area, thereby forming a final preliminary workpiece;

(b) inserting said final preliminary workpiece into a mold;

(c) providing a molten second metal; and (d) pouring said molten second metal into said mold so that it flows about and covers said beads and permitting said molten second metal to cool, thereby forming an article made of said second metal, which is mechanically interlocked to said beads, clad by said first metal.

9. The method of claim 8 wherein said final preliminary workpiece is used as said cladding workpiece.

10. The method of claim 8 wherein said final preliminary workpiece is cut into sections, one of said sections being used as said cladding workpiece.

11. The method of claim 8, wherein said binder includes metal particles.

12. The method of claim 8, wherein said binder includes carbon particles.

13. The method of claim 8, wherein said metal beads are spheroids.

14. The method of claim 8, wherein said step of heating said workpiece causes necks to form between said beads and said portion of said external surface area.

15. The method of claim 14, wherein the cross-sectional diameter of said necks is smaller than the diameter of said beads.

16. The method of claim 8, wherein said step of heating said workpiece also includes carburizing said workpiece.

17. The method of claim 8, wherein said step of heating said workpiece also includes nitriding said workpiece.

18. The method of claim 8, wherein said step of heating said workpiece also includes annealing said workpiece.

19. The method of claim 8, wherein said step of heating said workpiece also includes normalizing said workpiece.

20. The method of claim 8, further including a step of machining said final preliminary workpiece.

21. The method of claim 20, further comprising coating said final preliminary workpiece after machining.

22. The method of claim 8, further comprising shaping said final preliminary workpiece.

23. The method of claim 8, further comprising deforming said metal beads by pressing said metal beads of said final preliminary workpiece.

24. The method of claim 8, further comprising coating said final preliminary workpiece.

25. A method for manufacturing a clad component comprising:

(a) providing a cladding workpiece having a section comprising a first metal, said section having an external surface area;

(b) providing a binder to adhere metal beads to said cladding workpiece;

(c) bonding a multiplicity of metal beads rigidly to at least a portion of said external surface area:

(d) inserting said workpiece into a mold;

(e) providing a molten second metal; and (f) pouring said molten second metal into said mold so that it flows about and covers said beads and permitting said molten second metal to cool, thereby forming an article made of said second metal, which is mechanically interlocked to said beads, clad by said first metal.

26. The method of claim 25, further comprising heating said cladding workpiece and permitting said cladding workpiece to cool, wherein said heating and cooling is sufficient to form a rigid bond between said metal beads and said cladding workpiece.

* * * * *